US008726429B1

(12) United States Patent
Midkiff

(10) Patent No.: US 8,726,429 B1
(45) Date of Patent: May 20, 2014

(54) SPA AND SPA COVER ASSEMBLY

(71) Applicant: David Midkiff, Glendale, AZ (US)

(72) Inventor: David Midkiff, Glendale, AZ (US)

( * ) Notice: Subject to any disclaimer, the term of this patent is extended or adjusted under 35 U.S.C. 154(b) by 0 days.

(21) Appl. No.: 14/040,291

(22) Filed: Sep. 27, 2013

Related U.S. Application Data

(60) Provisional application No. 61/839,030, filed on Jun. 25, 2013.

(51) Int. Cl.
*E04H 4/00* (2006.01)

(52) U.S. Cl.
USPC ..... 4/498

(58) Field of Classification Search
USPC ..... 4/498
See application file for complete search history.

(56) References Cited

U.S. PATENT DOCUMENTS 5,566,403 A 10/1996 Black et al.
5,819,332 A * 10/1998 Perry ..... 4/498
5,974,599 A 11/1999 Tudor
5,974,600 A * 11/1999 Pucci et al. ..... 4/498
6,000,072 A 12/1999 LaHay
6,032,305 A 3/2000 Tedrick
6,634,036 B2 10/2003 Tudor
6,842,917 B1 1/2005 Genova
7,752,685 B2 7/2010 Tudor et al.
8,468,617 B2 6/2013 Gardenier et al.
8,479,325 B2 * 7/2013 Gardenier et al. ..... 4/498
2011/0048654 A1 3/2011 Kolar
2012/0066828 A1 3/2012 Kite
2013/0104307 A1 5/2013 Genova

* cited by examiner

*Primary Examiner* — Huyen Le
(74) *Attorney, Agent, or Firm* — Booth Udall Fuller, PLC

(57) ABSTRACT

Spa cover assemblies for use with a spa are contemplated herein. Each cover assembly is configured to pivotally couple to opposing end walls of the spa base and pivot between a closed position and an open position. Each cover assembly includes a first cover piece pivotally coupled to an end wall of the spa base, two bracket assemblies pivotally coupled to the end wall and the first cover piece, and a second cover piece pivotally coupled to the first cover piece. The second cover piece is substantially planar with the first cover piece when in the closed position and stacked on the first cover piece when in the open position. The first and second cover pieces form a shelf extending from the spa base when in the open position.

19 Claims, 4 Drawing Sheets

SPA AND SPA COVER ASSEMBLY

CROSS REFERENCE TO RELATED APPLICATIONS

This document claims the benefit of the filing date of U.S. Provisional Patent Application 61/839,030, entitled "Spa Cover" to Midkiff that was filed on Jun. 25, 2013, the contents of which are hereby incorporated by reference.

BACKGROUND

1. Technical Field

Aspects of this document relate generally to spas and spa covers.

2. Background Art

Spa covers provide an important safety and maintenance feature for spas. Previous spa covers typically consist of one- or two-piece spa covers. These two-piece spa covers include vinyl-wrapped foam typical to acrylic spas or plastic covers typical to roto-molded spas. These two-piece covers are either slid on and off the spa by hand or with a cover lifter that mounts to the spa. Whether for acrylic or roto-molded spas, typical two-piece covers are often cumbersome and difficult for users to lift and move between open and closed positions. This is particularly true for elderly persons, who are often weaker and frailer than others. Elderly persons are the primary customer demographic for spas.

SUMMARY

According to a first aspect, a spa assembly comprises a spa base, a first cover assembly, and two or more bracket assemblies. The spa base comprises opposing end walls, opposing sidewalls, two or more bracket supports on an outside surface of at least a first end wall of the opposing end walls, the spa base forming a water chamber between the two end walls and two sidewalls. The first cover assembly is pivotally coupled to the first end wall and pivotable between a closed position covering at least a portion of the water chamber and an open position extending outward from the first end wall to form a shelf substantially parallel to a top plane of the spa base and uncover the water chamber. The first cover assembly comprises a first cover piece pivotally coupled to the two or more bracket supports and comprising a first side that faces the water chamber when in the closed position and faces a direction opposite the water chamber when in the open position. The first cover assembly also comprises a second cover piece pivotally coupled to the first cover piece opposite the first end wall and comprising a first side that faces the water chamber when in the closed position and faces the first side of the first cover piece when in the open position. The two or more bracket assemblies support the first cover assembly in the open position, each bracket assembly comprising a first arm pivotally coupled to the first cover piece, a second arm pivotally coupled to the first arm and pivotally coupled to one of the two bracket supports.

Various implementations and embodiments may comprise one or more of the following. Two or more bracket supports on an outside surface of a second end wall of the two end walls, a second cover assembly pivotally coupled to the second end wall and pivotable between a closed position that covers at least a portion of the water chamber and an open position that extends outward from the first end wall to form a shelf substantially parallel to a top plane of the spa base and uncover the water chamber, the second cover assembly comprising: a first cover piece pivotally coupled the two or more bracket supports of the second end wall and comprising a first side that faces the water chamber when in the closed position and faces opposite the water chamber when in the open position, and a second cover piece pivotally coupled to the first cover piece opposite the first end wall and comprising a first side that faces the water chamber when in the closed position and faces the first side of the first cover piece when in the open position. Two or more bracket assemblies that support the second cover assembly in the open position, each bracket assembly comprising a first arm pivotally coupled coupled to the first cover piece, a second arm pivotally coupled to the first arm and pivotally coupled to one of the two bracket supports. A central grip positioned on the first cover piece of each of the first and second cover assemblies opposite the respective end wall and a hand notch aligned with the hand grip on the second cover piece of each of the first and second cover assemblies. The second cover piece of each of the first and second cover assemblies may further comprise opposing guide walls positioned to align the two sidewalls of the spa base between the guide walls when the second cover piece is in the closed position and transitioning to the open position, and an off-set end, each of the two off-set ends shaped complementary to the other such that the off-set ends of the two second cover pieces abut one another when in the closed position. Each first arm may be housed within a corresponding cover slot on the first cover piece when the first and second cover assemblies are in the closed and open positions, and each bracket support may comprise a support slot extending at least partially therethrough, the support slot sized to house the second arm therein when the respective first and second cover assemblies are in the closed position. The spa base may comprise a roto-molded spa base and the first and second cover pieces may comprise roto-molded first and second cover pieces, each of the spa base, first cover piece, and second cover piece having a composition comprising polyethylene.

According to a second aspect, a spa assembly comprises a spa assembly and two cover assemblies. The spa base comprises opposing end walls, opposing sidewalls, and a water chamber formed between the opposing end walls and opposing sidewalls. The two cover assemblies are each pivotally coupled to a different end wall of the spa base and pivotable between a closed position partially covering the water chamber and an open position forming a shelf extending outward substantially perpendicular from the end wall. Each cover assembly comprises a first cover piece pivotally coupled to a different one of the two end walls, two bracket assemblies pivotally coupled to the end wall and pivotally coupled to the first cover piece, and a second cover piece pivotally coupled to the first cover piece opposite the end wall and positioned substantially planar with the first cover piece when in the closed position and on top of the first cover piece when in the open position.

Various implementations and embodiments may comprise one or more of the following. Each bracket assembly may comprise a first arm pivotally coupled to the first cover piece, and a second arm pivotally coupled to the first arm opposite the first cover piece and pivotally coupled opposite the first arm to the respective end wall. Each first cover piece may comprise a first side that faces the water chamber when in the closed position and faces opposite the water chamber when in the open position, and each second cover piece comprises a first side that faces the water chamber when in the closed position and faces the first side of the first cover piece when in the open position. The first arm of each bracket assembly may be pivotally coupled to the first cover piece within a cover slot on the first cover piece, each end wall may comprise two bracket supports extending therefrom, and the second arm of each bracket assembly may be at least partially positioned within a support slot of one of the bracket supports. Each first arm may be positioned within its corresponding cover slot when the cover assembly is in the closed position and in the open position, each second arm may be positioned within the support slot of it corresponding bracket support when the cover assembly is in the closed position, and each second arm may extend between the end wall and the first cover piece when the cover assembly is in the open position. Each first cover piece may comprise a hand grip on and end opposite the end wall to which the end wall to which the first cover piece is coupled, and each second cover piece may comprise two opposing guide walls positioned to align the two sidewalls of the spa base between the two guide walls when the first and second cover pieces are in the closed position and transitioning to the open position. The spa base may comprise a roto-molded spa base and the first and second cover pieces may comprise roto-molded first and second cover pieces, each of the spa base, first cover piece, and second cover piece having a composition comprising polyethylene.

According to another aspect, a spa assembly comprises a roto-molded spa base and two cover assemblies. The roto-molded spa base has a composition comprising polyethylene, the spa-base and comprises two opposing end walls, two opposing sidewalls, and a water chamber formed between the two end walls and two sidewalls. The two cover assemblies are each coupled to a different end wall of the spa base and pitvotable between a closed position partially covering the water chamber and an open position uncovering the water chamber. Each cover assembly comprises a roto-molded first cover piece pivotally coupled to a different one of the two end walls and a roto-molded second cover piece pivotally coupled to the first cover piece opposite the end wall to which the first cover piece is coupled. Each of the first and second cover pieces having a composition comprising polyethylene.

Various implementations and embodiments may comprise one or more of the following. Each cover assembly may comprise two bracket assemblies, each bracket assembly comprising a first arm pivotally coupled to the first cover piece, a second arm pivotally coupled to the first arm and pivotally coupled opposite the first arm to the end wall to which the first cover piece is coupled, each cover assembly forming a shelf extending outward substantially perpendicular from the end wall to which the cover assembly is coupled when the cover assembly is in the open position. The first and second cover pieces may be substantially planar with one another when the cover assembly is in the closed position and the second cover pieces is position above the first cover piece when the cover assembly is in the open position. Each first cover piece may comprise a first side that faces the water chamber when the cover assembly is in the closed position and opposite the water chamber when the cover assembly is in the open position, and each second cover piece comprises a first side that faces the water chamber when the cover assembly is in the closed position and faces the first side of the first cover piece when the cover assembly is in the open position. The first arm of each bracket assembly may be pivotally coupled to the first cover piece within a cover slot on the first cover piece and each end wall may comprise two bracket supports extending therefrom, the second arm of each bracket assembly being at least partially positioned within a support slot of one of the bracket supports. Each first arm may be positioned within its corresponding cover slot when the cover assembly is in the closed position and in the open position, each second arm may be positioned within the support slot of its corresponding bracket support when the cover assembly is in the closed position, and each second arm may extend between the end wall and the first cover piece when the cover assembly is in the open position. Each first cover piece may comprise a hand grip on and end opposite the end wall to which the end wall to which the first cover piece is coupled, and each second cover piece may comprise two opposing guide walls positioned to align the two sidewalls of the spa base between the two guide walls when the first and second cover pieces are in the closed position and transitioning to the open position.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended spa and spa cover assembly and/or assembly procedures for a spa and spa cover assembly will become apparent for use with implementations of spas and spa cover assemblies from this disclosure. Accordingly, for example, although particular spas and spa cover assemblies may be disclosed, such spa and spa cover assemblies and implementing components may comprise any shape, size, style, type, model, version, measurement, concentration, material, quantity, and/or the like as is known in the art for such spas and spa cover assemblies and implementing components, consistent with the intended operation of a spa and a spa cover assembly.

Reference is made throughout this document to spas and spa covers. It is understood, however, that the spas referenced herein include hot tubs and other such water containing units. Spas are typically either an acrylic based or roto-molded spa. Acrylic spas typically include shells composed of fiberglass and/or acrylic with a skirt wrapped around the shell. These acrylic spas typically utilize a cover made of foam and wrapped in vinyl. Roto-molded spas are typically made of polyethylene and include a shell and skirt molded as one piece. As shall be discussed in greater detail throughout this document, it is contemplated that the disclosures presented herein may be applied to either an acrylic or roto-molded spa. For example, in one or more embodiments, both the spa base 2 and cover pieces 11, 12 may comprise a roto-molded polyethylene based material. Alternatively, any of the cover assemblies 10 disclosed herein may be adapted to an acrylic spa. In such embodiments, the cover assemblies 10 may be either a roto-molded polyethylene based material or, alternatively, be any other materials apparent to one of ordinary skill in the art.

Figure 1:
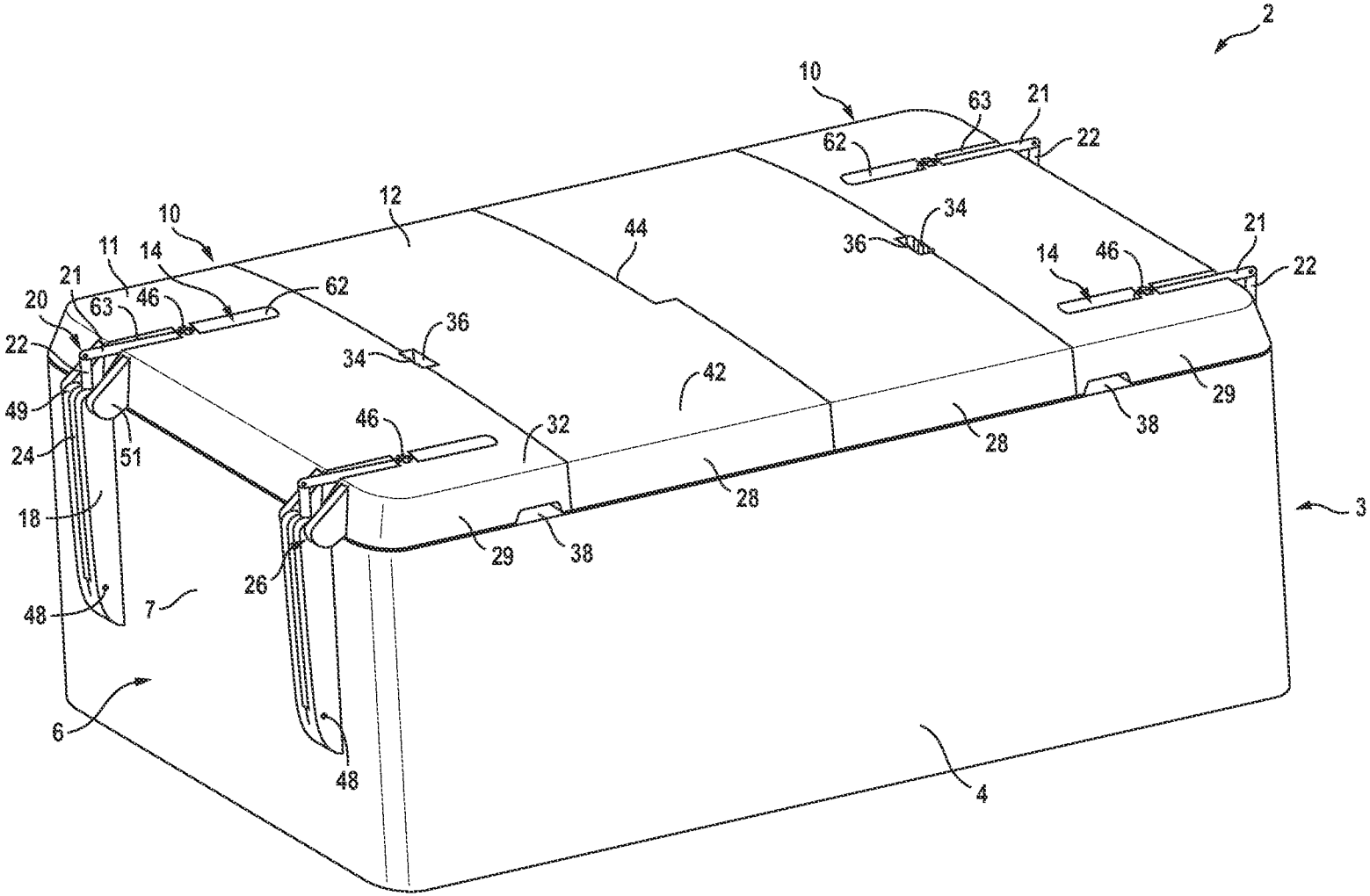
FIG. 1 is a perspective view of a spa and spa cover assembly with the spa cover assembly in a closed position.

FIG. 1 depicts one exemplary embodiment of a spa assembly 2 in a closed position. In one or more embodiments, a spa assembly 2 comprises a spa base 3 and one or more cover assemblies 10. The spa base 3 may comprise a spa base previously known in the art with or without modifications apparent to one of ordinary skill in the art upon review of the disclosures presented herein. By way of example, an embodiment of a spa base 3 comprises two opposing end walls 6 and two opposing sidewalls 4. The two opposing sidewalls 4 typically extend between the two opposing end walls 6 to form a water chamber 5 (shown in FIG. 2) formed between the sidewalls 4 and the end walls 6. The water chamber 6 is configured to hold water therein and may be adapter to couple to one or more water jets, pumps, drains, and the like as previously known in the art of spas.

One or more embodiments of a spa base 3 comprise a track 9 at the top plane 8 of the spa base 3. The track 9 may surround the entire water chamber 5 or, alternatively, may extend from only the sidewalls 4 or the end walls 6. The track 9 typically comprises a portion of the sidewalls 4 and/or end walls 6 adjacent the top plane 8 of the spa base 3, but more narrow than the remainder of the sidewalls 4 and/or end walls 6. That is, a lip is typically formed at the boundary of the track 9 and the sidewalls 4 and/or end walls 6.

One or more embodiments of a spa base 3 comprise at least one bracket support 18 on one or more of the end walls 6. Typically, the spa base 3 will comprise two brackets supports 18 for each cover assembly 10 coupled thereto. It is contemplated, however, that the spa assembly 2 may comprise more than two bracket supports 18 for each cover assembly 10. In the particular embodiment depicted in FIG. 1, the bracket support 18 extends outward from an outer surface 7 of the end wall 6. The bracket support 18 may, however, also be molded or otherwise formed into the end wall 6 in other embodiments. In embodiments wherein the bracket support 18 extends outward from the end wall 6, the bracket support 18 may be fixedly coupled, removably coupled, or molded to the end wall 6.

The bracket support 18 comprises any configuration that allows pivotal coupling of the bracket assembly 20 thereto. In a particular embodiment, the bracket support comprises a support slot 24 extended at least partially through the bracket support 18, the support slot 24 being sized to fit at least a portion of a second arm 22 of the bracket assembly 20 within the support slot 24. For example, in FIG. 1, the second arm 22 of the bracket assembly 20 is positioned within the support slot 24 when the cover assembly 10 is in the closed position. In other embodiments, however, the bracket support 18 comprises no support slot 18. In such embodiments, the second arm 22 of the bracket assembly is positioned adjacent the bracket support 18 when the cover assembly 10 is in the closed position.

As depicted in FIGS. 1-5, in one or more embodiments, a bracket support 18 is configured to allow pivotal coupling a second arm 22 of the bracket assembly 20 to the bracket support 18. The second arm 22 of the bracket assembly 20 may be coupled to the bracket support 18 with a second arm coupling 48. The second arm coupling 48 may comprise any coupling that allows pivotal movement of the second arm 22 in relation to the bracket support 18. In a particular embodiment, the second arm coupling 48 comprises a pin that extends through the bracket support 18 and the second arm 22 to pivotally couple the second arm 22 to the bracket support 18. In other embodiments, the second arm coupling 48 may comprise any coupling known in the art that allows pivotal movement of the second arm 22 in relation to the bracket support 18.

Figure 4:
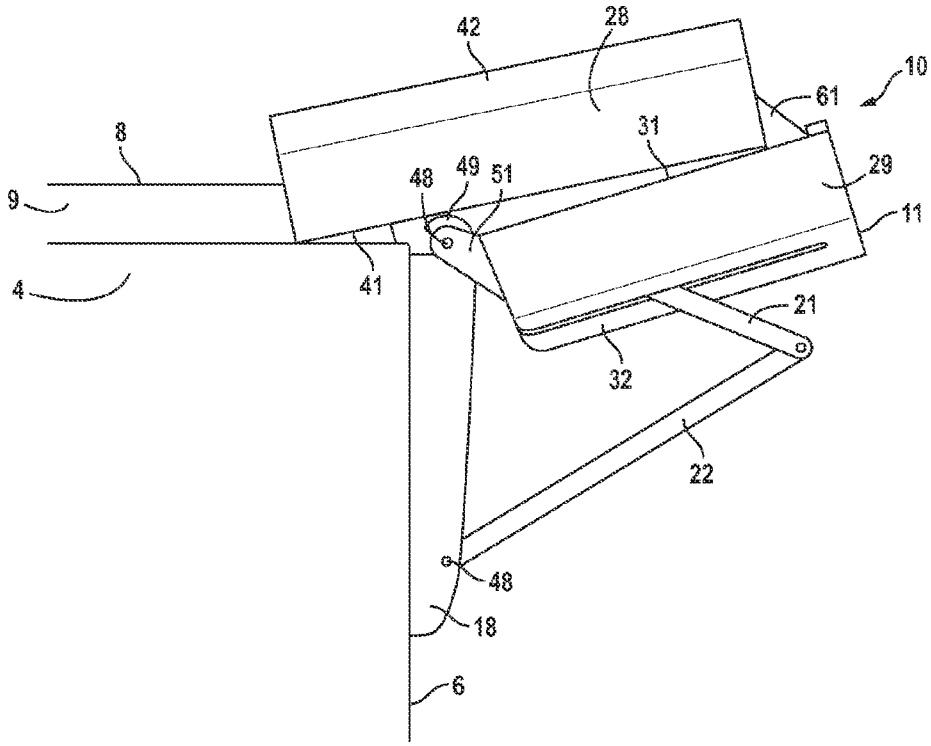
FIG. 4 is a side view of a spa and spa cover assembly with the spa cover assembly in transition between the open position and the closed position.

As depicted in FIG. 4, one or more embodiments of a bracket support 18 further comprise one or more C-shaped mounts 49. In particular embodiments, the bracket comprises two C-shaped mounts 49, with one C-shaped mount 49 on each side of the support slot 24. The C-shaped mount 49 is typically opposite the second arm coupling 48 and configured to pivotally couple to a pin 48 of the cover assembly 10. Pivotal coupling of the pin 48 to the C-shaped mount 49 allows for pivotal movement of the cover assembly 10, typically the first cover piece 11, in relation to the spa base 3. In other embodiments, the C-shaped mount 49 may be positioned on the end wall 6 of the spa base 3. The C-shaped mount 49 may, in certain embodiments be configured for removable coupling of the cover assembly 10 to the spa base 3.

Various embodiments of spa assemblies contemplated herein further comprise at least one cover assembly 10 coupled to the spa base 3. While FIG. 1 depicts a spa assembly 2 comprise two cover assemblies 10 coupled to opposing end walls 6, other embodiments may comprise only one cover assembly 10 that extends over the enter water chamber 5 when the cover assembly 10 is in the closed position. Each cover assembly 10 comprises a first cover piece 11 pivotally coupled to spa base 2 and a second cover piece 12 pivotally coupled to the first cover piece.

In one or more embodiments, the first cover piece 11 is pivotally coupled to an end wall 6 and comprises a first side 31 and a second side 32 opposite the first side 31. As shall be described in greater detail below, the first side 31 of the first cover piece 11 faces downward or toward the water chamber 5 when the cover assembly is in the closed position. When the cover assembly 10 is moved to the open position to form a shelf 50, the first side 31 of the first cover piece 11 faces opposite, or upward and away from the water chamber 5. The first cover piece 11 may be pivotally coupled directly to the end wall 6 or, alternatively, pivotally coupled to one or more bracket supports 18 extending from the end wall 6. In FIGS. 1-5, the first cover piece 11 is pivotally coupled to two bracket supports 18 extending from an end wall 6. In other embodiments, the first cover piece 11 may be pivotally coupled to three or more bracket supports 18.

The first cover piece 11 is typically pivotally coupled to bracket support(s) 18 with a pivot coupling 26. As briefly described above, in some embodiments, the pivot coupling 26 comprises one or more pins 48 rotatable within one or more C-shaped mounts 49 of the bracket support 18. The pin 48 is either coupled to the first cover piece 11 or molded integral with the first cover piece 11. More particularly, a pin 48 may extend from a pin support 51 that extends from one end of the first cover piece 11. Even more particularly, certain embodiments comprise two pin supports 51 extend from one end of the first cover piece, the two pin supports 51 positioned or otherwise spaced to allow a portion of the bracket support 18 to fit between the two pin supports 51. In such an embodiment, a different pin 48 extends from each of the two pin supports 51, the two pins 48 extending toward each other. This configuration provides additional stability and support to the first cover piece 11 by coupling the first cover piece 11 to the each bracket support 18 in two place, while still allowing the second arm 22 to fit between the two pins 48 when the cover assembly 10 is in the closed position (as shown in FIG. 1).

One or more embodiments of a first cover piece 11 further comprise at least one cover slot 14. Typically, the first cover piece 11 comprises one cover slot 14 for each bracket assembly 20. For example, in FIGS. 1-3, the first cover piece 11 depicted comprises two cover slots 14 aligned with two bracket assemblies 20. Each cover slot 14 is sized to fit at least a portion of a first arm 21 of the bracket assembly therein. In some embodiments, a first arm coupling 46 is positioned at least partially within the cover slot 14, dividing the cover slot 14 into two portions. The first arm coupling 46 is configured to pivotally couple the first arm 21 of the bracket assembly to the first cover piece 11. In a particular embodiment, the first arm coupling 46 comprises one or more pins mounted between the cover slot 14, each of the one or more pins at least partially extending into or through the first arm 21 such that the first arm 21 is pivotally coupled to the first cover piece 11. In one aspect, the one or more pins of the first arm coupling 46 are mounted within channels molded into the cover slot 14.

As previously referenced, the first arm coupling 46 is positioned between a first and a second portion 62 of the cover slot 14. As depicted in FIG. 1, the first arm 21 of the bracket assembly 20 is positioned within a first portion 63 of the cover slot 14 adjacent the bracket support 18 when the cover assembly 10 is in the closed position. As the cover assembly 10 is moved from the closed position (shown in FIG. 1) to the open position (shown in FIG. 5), the first arm 21 pivots from positioning within first portion 63 of the cover slot 14 to positioning within a second portion 62 of the cover slot 14. Thus, at least a portion of the first arm 21 is positioned within a first portion 63 of the cover slot 14 when in the closed position (shown in FIG. 1), and a portion of the first arm 21 is positioned within a second portion 62 of the cover slot 14 when in the open position (shown in FIG. 5). Positioning of the first arm 46 within the cover slot 14 when in the closed and open positions provides additional support and stability for the cover assembly 10, especially when the cover assembly 10 forms a shelf 50 in the open position.

Figure 5:
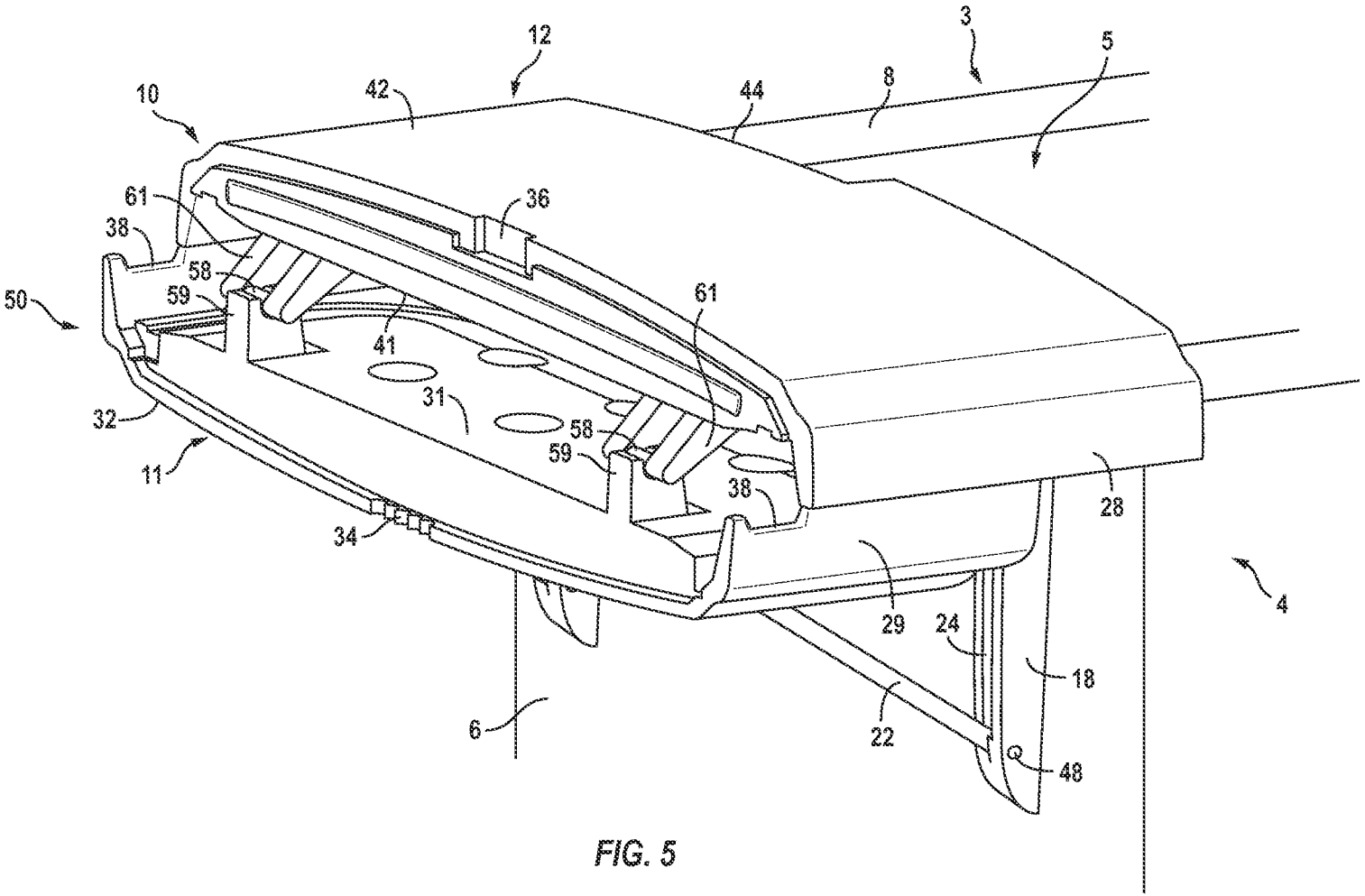
FIG. 5 is a perspective view of the spa and spa cover assembly with the spa cover assembly in an open position forming a shelf.

In one or more embodiments, a first cover piece 11 comprises one or more hand grips. In the particular embodiment depicted in FIG. 1, the first cover piece 11 comprises a central grip 34 and two opposing side grips 38. The central grip 34 and/or the side grips 38 may comprise finger notches, hand slots, holes, and the like or any combination thereof. As depicted in FIGS. 1 and 5, the central grip 34 is positioned on end of the first cover piece 11 opposite the end wall 6 to which it is coupled and comprises a plurality of finger notches. In other embodiments, however, the central grip 34 may be positioned anyway one the first cover piece 11, including formation as a cavity on the second side 32 of the first cover piece 11. The side grips 38 are typically positioned on opposing sides of the first cover piece 11 and comprise a hand slot. In one or more embodiments, the hand grips are molded into the first cover piece 11. Particular embodiments comprising the one or more hand grips are advantageous over conventional spa covers because with conventional spa covers the user is required to reach across the spa cover to reach the opposing side of the spa cover to lift the cover and with hand grips, the user may more easily grip the cover.

One or more embodiments of a first cover piece 11 further comprise opposing guide walls 29 extending from opposing edges of the first cover piece 11. In a particular embodiment, the guide walls 29 are positioned such that opposing sidewalls 4 of the spa base 3 fit between the two guide walls 29. In embodiments of the spa base 3 comprising a track 9, the tracks 9 of the opposing sidewalls 4 fit between the two guide walls 29. The guide walls 29 are advantageous to hold the first cover piece 11 in position or keep the first cover piece 11 from moving in an undesired location when the first cover piece 11 is in the closed position. A track 9, however, is not required in embodiments comprising the guide walls 29.

One or more embodiments of a cover assembly 10 further comprise one or more pivot couplings 16 that pivotally couple the first cover piece 11 to the second cover piece 12. While the embodiment depicted in FIG. 5 comprises two pivot couplings 16, other embodiments may comprise one, three, four or more pivot couplings 16. The pivot 16 coupling may comprise any pivot coupling known in the art. In the particular embodiment depicted in FIG. 5, the pivot coupling 16 comprises a C-shaped mount 59 coupled to or otherwise extending from the first side 31 of the first cover piece 11. The pivot coupling 16 typically further comprises a pin 58 coupled to the second cover piece 12 and rotatable within the C-shaped opening of the C-shaped mount 59. In other embodiments, the pivot coupling 16 may be positioned elsewhere on the first cover piece 11 and the second cover piece 12.

The second cover piece 12 is pivotally coupled to the first cover piece 11 opposite the end wall 6 to which the first cover piece 11 is pivotally coupled. In a particular embodiment, each pivot coupling 16 further comprises one or more pin supports 61 extending from the second cover piece 12. The pin supports 61 may be coupled to or molded integrally with the second cover piece 12. In the particular embodiment depicted in FIG. 5, a pin 58 extends between two pin supports 61 extending from the first side 41 of the second cover piece 12. In other embodiments, the pin supports 61 may extend from any portion of the second cover piece 12.

The second cover piece 12 comprises a first side 41 that faces downward toward the water chamber 5 when the cover assembly 10 is in the closed position. When the cover assembly 10 is in the open position, the first side 41 of the second cover piece 12 faces the first side 31 of the first cover piece 11. In other words, the first side of the second cover piece 12 still faces downward when then the cover assembly 10 is in the open position. Thus, the second side 42 of the second cover piece 12 opposite the first side 41 faces upward or away from the water chamber 5 when the cover assembly 10 is in both the closed and open positions.

Figure 2:
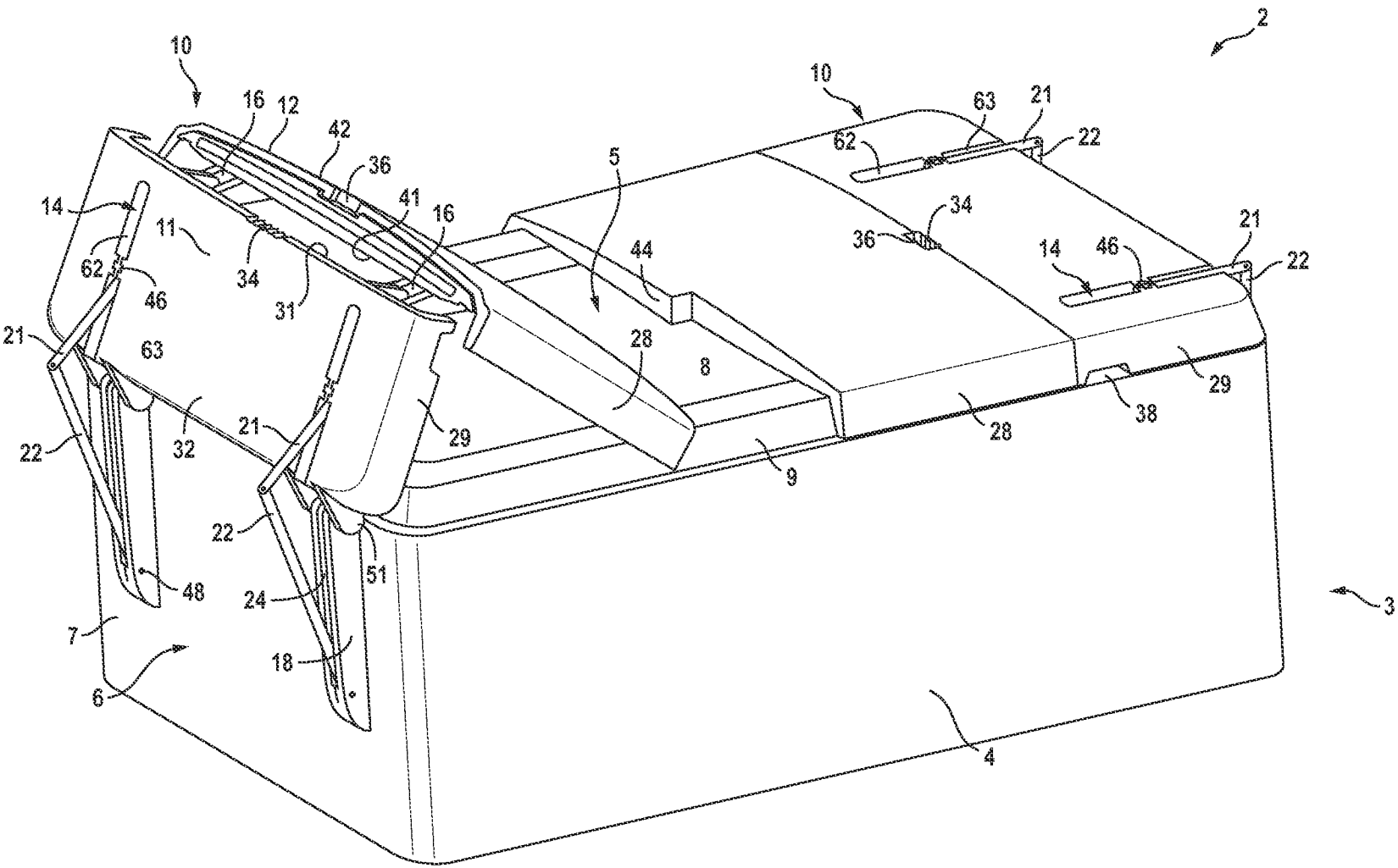
FIG. 2 is a perspective view of a spa and spa cover assembly with the spa cover assembly in transition between the open position and the closed position.

As depicted in FIGS. 1 and 5, particular embodiments of a second cover piece 12 may comprise a non-planar end 44 opposite the first cover piece 11. The non-planar end 44 may comprise any configuration that is shaped to complementary to a non-planar end of the second cover piece 12 of the opposite cover assembly 10, such as but not limited to one or more teeth, protrusions, and the like. For example, in FIG. 1, the second cover pieces 12 of the two cover assemblies 10 coupled to the spa base 3 each comprise a protrusion on the non-planar end 44 that complements the other second cover piece 12. More particularly, the non-planar end may comprise an offset edge. The offset edge comprises a horizontally offset edge, as depicted in FIGS. 1-2. The non-planar ends 44 of the second cover pieces 12 provide additional stability for the cover when the cover assemblies are in the closed position, as well as providing a better locking and sealing mechanism for the cover assemblies when two cover assemblies 10 are in a closed position. An offset edge on the non-planar end 44 is particularly advantageous because the second cover pieces 12 may be made from the same mold during manufacture. Two different molds are not required to make two complementing second cover pieces 12 that are configured to create a seal. Conventional spa covers using complementary top lips and bottom lips require more than one mold, thus increasing the cost of manufacture.

In one or more embodiments, the second cover piece 12 comprises a hand notch 36. The hand notch is typically positioned to align with the central grip 34 of the first cover piece 11 and is sized such that a hand of a user may fit therein during opening and closing of the cover assembly 10 without pinching or otherwise harming the hand of the user. It is further contemplated that the second cover piece 12 may comprise any of the hand grips described above in connection with the first cover piece 11.

One or more embodiments of a second cover piece 12 further comprise opposing guide walls 28 extending from opposing edges of the second cover piece 12. In a particular embodiment, the guide walls 28 are positioned such that opposing sidewalls 4 of the spa base 3 fit between the two guide walls 28. In embodiments of the spa base 3 comprising a track 9, the tracks 9 of the opposing sidewalls 4 fit between the two guide walls 28. The guide walls 28 are advantageous to hold the second cover piece 12 in position or keep the second cover piece 12 from moving in an undesired location when the second cover piece 12 is in the closed position or sliding along the top plane 8 of the spa base 3 from the closed position to the open position. A track 9, however, is not required in embodiments comprising the guide walls 29.

As referenced above, embodiments of the spa assembly 2 further comprise one or more bracket assemblies 20 coupled to each end wall 6 and each first cover piece 11. Typically two bracket assemblies 20 are coupled to each end wall 6 and each first cover piece 11, although some embodiments may comprise one, three, four, or more bracket assemblies 20 coupled to each end wall 6 and each first cover piece 11.

Each bracket assembly comprises a first arm 21 pivotally coupled to the first cover piece 11. In one or more embodiments, one end of the first arm 21 is pivotally coupled to the first cover piece 11 within the cover slot 14 of the first cover piece 11 with a first arm coupling 46. The first arm coupling 46 may comprise any coupling that allows pivotal movement of the first arm 21 in relation to the first cover piece 11. In a particular embodiment, the first arm coupling 46 comprises a U-shaped bracket positioned within the cover slot 14 and removably coupled to the first cover piece 11 with a screw or bolt. A pin extends through the U-shaped bracket and first arm 21 to pivotally couple the first arm 21 to the first cover piece 21 in this embodiment. As previously described, the first arm 21 is sized to fit at least partially within the cover slot 14 when in the open and close positions. In other embodiments, the first arm 21 is coupled elsewhere on the second side 32 of the first cover piece 11. As previously described, the first arm 21 is sized to fit at least partially within the cover slot 14 when in the open and close positions.

Each bracket assembly further comprises a second arm 22 pivotally coupled to the first arm 21 opposite the first cover piece 11. Pivotal coupling of the first arm 21 to the second arm 22 may comprise any pivotal coupling known in the art, such as but not limited to pin or other element extending through the first arm 21 and second arm 22.

The second arm 22 is further pivotally coupled to the end wall 6 with a second arm coupling 48 in one or more embodiments. The second arm coupling 48 may comprise any coupling that allows pivotal movement of the second arm 22 in relation to the end wall 6 to which it is coupled. In one or more embodiments, the second arm 22 is pivotally coupled to the bracket support 18 extending from or coupled to the end wall 6. The second arm coupling 48 of may comprise a pin that extends through at least a portion of the second arm 22 and at least a portion of the bracket support 18. In a particular embodiment, the pin extends through the bracket support and the second arm 22. In other embodiments, the second arm 22 is pivotally coupled directly to the end wall 6.

One or more embodiments of a spa assembly 2 comprise one or more cover assemblies 10 movable between an open position and a closed position. In a particular embodiment, the spa assembly 2 comprises only one cover assembly 10 that covers all or substantially all of the water chamber 5 when the cover assembly is in the closed position. In other embodiments, as depicted in FIG. 1, the spa assembly 2 comprises two cover assemblies 10, each cover assembly 10 being pivotally coupled to a different one of the two opposing end walls 6. When the spa assembly 2 comprises two cover assemblies 10, the two cover assemblies 10 are typically configured such that the second cover pieces 12 of the two cover assemblies 10 abut one another or are adjacent one another when both the cover assemblies are in the closed position, as depicted in FIG. 1. Although reference is made to a single cover assembly 10 throughout this document, it is contemplated that such references may apply to either the cover assembly 10 of an embodiment of a spa assembly with only one cover assembly 10, or the cover assembly 10 of an embodiment of a spa assembly 2 with two cover assemblies 10.

FIGS. 1-5 depict embodiments of a spa assembly 2 with a cover assembly 10 at different positions. Movement of the cover assembly 10 from the closed position may be accomplished via human intervention, such as a human grasping the central grip 34 and/or the side grip 38 and pulling the first cover piece 11 away from the spa base 3. Alternatively, movement of the cover assembly 10 from the closed position to the open position may be accomplished via any motorized or mechanical force exerted upon to cover assembly 10.

In FIG. 1, the cover assemblies 10 coupled to opposing end walls 6 are in a closed position that covers substantially all of the water chamber 5. In this close position, the first side 31 of the first cover piece 11 faces down toward the water chamber 5. The first side 41 of the second cover piece 12 also faces down toward the water chamber 5 when in the close position. In the particular embodiment depicted in FIG. 1, the first arm 21 of each bracket assembly 20 is positioned partially within the first portion 6 of the cover slot 14, the first arm 21 being substantially parallel to the top plan 8 of the spa base 3 and substantially perpendicular to the end wall 6 and the second arm 22. On the other hand, the second arm 22 of each bracket assembly 20 is positioned partially within the support slot 24 of the bracket support 18, the second arm 22 being substantially parallel to the end wall 6 and substantially perpendicular to the top plan 8 of the spa base 3.

Figure 3:
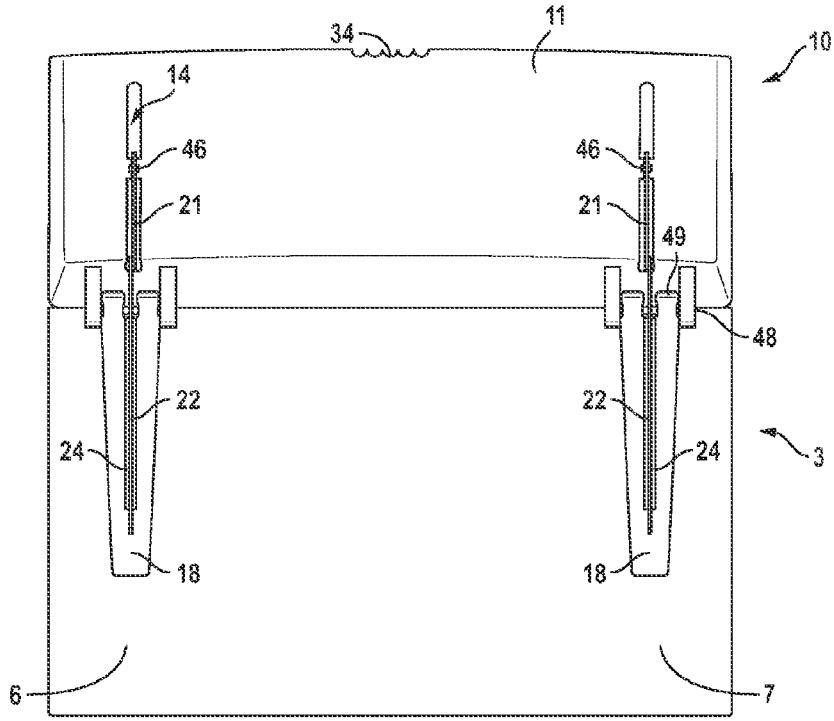
FIG. 3 is an end view of a spa and spa cover assembly with the spa cover assembly in transition between the open position and the closed position.

FIGS. 2 and 3 depict views of the cover assembly 10 coupled to a spa base 3 as the cover assembly 10 transitions from the closed position to an open position. As the first cover piece 11 is pulled away from the top plane 8 of the spa base 3, the first cover piece 11 and second cover piece 12 pivot in relation to the other. Simultaneously, a majority of the first arm 21 and second arm 22 move out of the cover slot 14 and support slot 24, respectively.

FIG. 4 depicts a side view of a cover assembly 10 and spa base 3 as the cover assembly 10 transitions from the closed position to the open position. In FIG. 4, the cover assembly 10 is nearly to the open position. As the first cover piece 11 continues to pivot, the first arm 21 begins to be positioned within a second portion 62 of the cover slot 14.

FIG. 5 depicts the perspective view of a cover assembly 10 and spa base 3 with the cover assembly 10 in the open position. In the open position, cover assembly 10 forms a shelf 50 substantially parallel to the top plane 8 and substantially perpendicular to the end wall 6 to which the cover assembly 10 is coupled. Typically, the cover assembly 10 does not cover any of the water chamber 5 of the spa base 3 when in the open position. As depicted in FIG. 5, in the shelf 50 formed by the first cover assembly 10 in the open position, the first side 31 of the first cover piece 11 faces up and away from the water chamber 5, while the first side 41 of the second cover piece 12 faces down towards the first side 31 of the first cover piece 11. That is, the movement of the cover assembly 10 from the closed position to the open position rotates the first cover piece 11 180 degrees. One the other hand, although the second cover piece 12 pivots in relation to the first cover piece 11 during transition from the closed position to the open position, the second cover piece comprises the same directional alignment in the closed position and the open position, with the first side facing down in both positions.

As further depicted in FIG. 5, the bracket assembly 20 supports the cover assembly 10 in the open position to form a shelf 50. In the open position, the first arm 21 of the bracket assembly is typically positioned within the second portion 62 of the cover slot 14, the first arm 21 being substantially parallel to the top plane 8 and substantially perpendicular to the end wall 6. The second arm 22 of the bracket assembly 20 extends at an angle outward from the bracket support 18 or end wall 6 to the first arm 21. In this position, the first arm 21 and second arm 22 help support the cover assembly 10 in the open position.

Movement of the cover assembly 10 from the open position to the close position is similar to movement of the cover assembly 10 from the closed position to the open position. Instead of pull the first cover piece 21 away from the spa base 3, however, the first cover piece 21 is typically lifted and pushed towards the spa base 3. As this occurs, the second cover piece 22 may slide along top plane 8 and/or track 9 of the spa base as the second cover piece 22 transitions from the open position to the closed position.

It will be understood that implementations are not limited to the specific components disclosed herein, as virtually any components consistent with the intended operation of a method and/or system implementation for a spa and spa cover assembly may be utilized. Accordingly, for example, although particular spas and spa cover assemblies may be disclosed, such components may comprise any shape, size, style, type, model, version, class, grade, measurement, concentration, material, weight, quantity, and/or the like consistent with the intended operation of a method and/or system implementation for spas and spa cover assemblies may be used.

In places where the description above refers to particular implementations of spas and spa cover assemblies, it should be readily apparent that a number of modifications may be made without departing from the spirit thereof and that these implementations may be applied to other spas and spa cover assemblies. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A spa assembly, comprising:

a spa base comprising opposing end walls, opposing sidewalls, two or more bracket supports on an outside surface of at least a first end wall of the opposing end walls, the spa base forming a water chamber between the two end walls and two sidewalls;

a first cover assembly pivotally coupled to the first end wall and pivotable between a closed position covering at least a portion of the water chamber and an open position extending outward from the first end wall to form a shelf substantially parallel to a top plane of the spa base and uncover the water chamber, the first cover assembly comprising:

a first cover piece pivotally coupled to the two or more bracket supports and comprising a first side that faces the water chamber when in the closed position and faces a direction opposite the water chamber when in the open position;

a second cover piece pivotally coupled to the first cover piece opposite the first end wall and comprising a first side that faces the water chamber when in the closed position and faces the first side of the first cover piece when in the open position; and two or more bracket assemblies that support the first cover assembly in the open position, each bracket assembly comprising a first arm pivotally coupled to the first cover piece, a second arm pivotally coupled to the first arm and pivotally coupled to one of the two bracket supports.

2. The spa assembly of claim 1, further comprising:

two or more bracket supports on an outside surface of a second end wall of the two end walls;

a second cover assembly pivotally coupled to the second end wall and pivotable between a closed position that covers at least a portion of the water chamber and an open position that extends outward from the first end wall to form a shelf substantially parallel to a top plane of the spa base and uncover the water chamber, the second cover assembly comprising:

a first cover piece pivotally coupled the two or more bracket supports of the second end wall and comprising a first side that faces the water chamber when in the closed position and faces opposite the water chamber when in the open position; and a second cover piece pivotally coupled to the first cover piece opposite the first end wall and comprising a first side that faces the water chamber when in the closed position and faces the first side of the first cover piece when in the open position; and two or more bracket assemblies that support the second cover assembly in the open position, each bracket assembly comprising a first arm pivotally coupled coupled to the first cover piece, a second arm pivotally coupled to the first arm and pivotally coupled to one of the two bracket supports.

3. The spa assembly of claim 2, further comprising a central grip positioned on the first cover piece of each of the first and second cover assemblies opposite the respective end wall and a hand notch aligned with the hand grip on the second cover piece of each of the first and second cover assemblies.

4. The spa assembly of claim 3, wherein the second cover piece of each of the first and second cover assemblies further comprises:

opposing guide walls positioned to align the two sidewalls of the spa base between the guide walls when the second cover piece is in the closed position and transitioning to the open position; and an off-set end, each of the two off-set ends shaped complementary to the other such that the off-set ends of the two second cover pieces abut one another when in the closed position.

5. The spa assembly of claim 4, wherein each first arm is housed within a corresponding cover slot on the first cover piece when the first and second cover assemblies are in the closed and open positions, and each bracket support comprises a support slot extending at least partially therethrough, the support slot sized to house the second arm therein when the respective first and second cover assemblies are in the closed position.

6. The spa assembly of claim 5, wherein the spa base comprises a roto-molded spa base and the first and second cover pieces comprise roto-molded first and second cover pieces, each of the spa base, first cover piece, and second cover piece having a composition comprising polyethylene.

7. A spa assembly, comprising:

a spa base comprising opposing end walls, opposing sidewalls, and a water chamber formed between the opposing end walls and opposing sidewalls;

two cover assemblies, each cover assembly pivotally coupled to a different end wall of the spa base and pivotable between a closed position partially covering the water chamber and an open position forming a shelf extending outward substantially perpendicular from the end wall, each cover assembly comprising a first cover piece pivotally coupled to a different one of the two end walls, two bracket assemblies pivotally coupled to the end wall and pivotally coupled to the first cover piece, and a second cover piece pivotally coupled to the first cover piece opposite the end wall and positioned substantially planar with the first cover piece when in the closed position and on top of the first cover piece when in the open position.

8. The spa assembly of claim 7, wherein each bracket assembly comprises a first arm pivotally coupled to the first cover piece, and a second arm pivotally coupled to the first arm opposite the first cover piece and pivotally coupled opposite the first arm to the respective end wall.

9. The spa assembly of claim 8, wherein each first cover piece comprises a first side that faces the water chamber when in the closed position and faces opposite the water chamber when in the open position, and each second cover piece comprises a first side that faces the water chamber when in the closed position and faces the first side of the first cover piece when in the open position.

10. The spa assembly of claim 9, wherein the first arm of each bracket assembly is pivotally coupled to the first cover piece within a cover slot on the first cover piece, each end wall comprises two bracket supports extending therefrom, and the second arm of each bracket assembly is at least partially positioned within a support slot of one of the bracket supports.

11. The spa assembly of claim 10, wherein each first arm is positioned within its corresponding cover slot when the cover assembly is in the closed position and in the open position, each second arm is positioned within the support slot of it corresponding bracket support when the cover assembly is in the closed position, and each second arm extends between the end wall and the first cover piece when the cover assembly is in the open position.

12. The spa assembly of claim 11, wherein each first cover piece comprises a hand grip on and end opposite the end wall to which the end wall to which the first cover piece is coupled, and each second cover piece comprises two opposing guide walls positioned to align the two sidewalls of the spa base between the two guide walls when the first and second cover pieces are in the closed position and transitioning to the open position.

13. The spa assembly of claim 12, wherein the spa base comprises a roto-molded spa base and the first and second cover pieces comprise roto-molded first and second cover pieces, each of the spa base, first cover piece, and second cover piece having a composition comprising polyethylene.

14. A spa assembly, comprising:

a roto-molded spa base having a composition comprising polyethylene, the spa-base comprising two opposing end walls, two opposing sidewalls, and a water chamber formed between the two end walls and two sidewalls; and two cover assemblies, each cover assembly coupled to a different end wall of the spa base and pitvotable between a closed position partially covering the water chamber and an open position uncovering the water chamber, and each cover assembly comprising a roto-molded first cover piece pivotally coupled to a different one of the two end walls, a roto-molded second cover piece pivotally coupled to the first cover piece opposite the end wall to which the first cover piece is coupled, and two bracket assemblies, each bracket assembly comprising a first arm pivotally coupled to the first cover piece, a second arm pivotally coupled to the first arm and pivotally coupled opposite the first arm to the end wall to which the first cover piece is coupled, wherein each cover assembly forms a shelf extending outward substantially perpendicular from the end wall to which the cover assembly is coupled when the cover assembly is in the open position, each of the first and second cover pieces having a composition comprising polyethylene.

15. The spa assembly of claim 14, wherein the first and second cover pieces are substantially planar with one another when the cover assembly is in the closed position and the second cover pieces is position above the first cover piece when the cover assembly is in the open position.

16. The spa assembly of claim 15, wherein each first cover piece comprises a first side that faces the water chamber when the cover assembly is in the closed position and opposite the water chamber when the cover assembly is in the open position, and each second cover piece comprises a first side that faces the water chamber when the cover assembly is in the closed position and faces the first side of the first cover piece when the cover assembly is in the open position.

17. The spa assembly of claim 16, wherein the first arm of each bracket assembly is pivotally coupled to the first cover piece within a cover slot on the first cover piece and each end wall comprises two bracket supports extending therefrom, the second arm of each bracket assembly being at least partially positioned within a support slot of one of the bracket supports.

18. The spa assembly of claim 17, wherein each first arm is positioned within its corresponding cover slot when the cover assembly is in the closed position and in the open position, each second arm is positioned within the support slot of its corresponding bracket support when the cover assembly is in the closed position, and each second arm extends between the end wall and the first cover piece when the cover assembly is in the open position.

19. The spa assembly of claim 18, wherein each first cover piece comprises a hand grip on and end opposite the end wall to which the end wall to which the first cover piece is coupled, and each second cover piece comprises two opposing guide walls positioned to align the two sidewalls of the spa base between the two guide walls when the first and second cover pieces are in the closed position and transitioning to the open position.

* * * * *